United States Patent [19]

Luecke et al.

[11] Patent Number: 4,937,983

[45] Date of Patent: Jul. 3, 1990

[54] ABRASIVE DISC BACK UP ASSEMBLY

[75] Inventors: Frederick R. Luecke, White Bear Lake; Thomas L. Jones, Stillwater; Conrad T. Freerks, St. Paul, all of Minn.

[73] Assignee: Minnesota Mining and Manufacturing Company, St. Paul, Minn.

[21] Appl. No.: 349,915

[22] Filed: May 9, 1989

Related U.S. Application Data

[63] Continuation of Ser. No. 118,296, Nov. 6, 1987, abandoned.

[51] Int. Cl.[5] ..... B24D 15/00

[52] U.S. Cl. ..... 51/392; 51/393

[58] Field of Search ..... 51/392, 391, 393, 358, 51/181 R, 205 R, 204, 211 R; 7/124; D 19/53

[56] References Cited

U.S. PATENT DOCUMENTS

| | | | |
|---|---|---|---|
| 819,271 | 5/1906 | Franke . | |
| 1,427,503 | 8/1922 | Wake | 51/392 |
| 1,427,507 | 8/1922 | Wake | 51/392 |
| 2,716,849 | 1/1955 | Blumstein | 51/187 |
| 2,996,850 | 8/1961 | Hoffman | 51/185 |
| 3,719,460 | 5/1971 | Brockman | 51/181 |
| 3,842,549 | 10/1974 | Johnston | 51/392 |
| 3,998,012 | 12/1976 | Ness | 51/391 |
| 4,361,990 | 12/1982 | Link | 51/392 |

OTHER PUBLICATIONS

Finesse-it System Commercial Literature by 3M.
Mechanical Design and Systems Handbook, 2nd Ed., McGraw Hill, 1964, p. 27.44.
Mechanical Design & Systems Handbook, Table 27.16.

*Primary Examiner*—Frederick R. Schmidt
*Assistant Examiner*—M. Rachuba
*Attorney, Agent, or Firm*—Donald M. Sell; Walter N. Kirn; William L. Huebsch

[57] ABSTRACT

A manually manipulatable pencil like abrasive disc back up assembly for supporting pressure sensitive adhesive coated abrasive discs while abrading defects in painted surfaces such as of automobiles. The assembly includes an elongate rigid body member having sockets opening through its ends, and firm flexible support members having inner portions in the sockets, and outer portions projecting from the sockets with planar end surfaces adapted to support one of the pressure sensitive adhesive coated abrasive discs.

8 Claims, 1 Drawing Sheet

ABRASIVE DISC BACK UP ASSEMBLY

This is a continuation of application Ser. No. 07/118,296 filed Nov. 6, 1987 now abandoned.

TECHNICAL FIELD

The present invention relates to manually manipulatable back up assemblies for abrasive discs used to abrade and thereby remove defects such as dust in paint coatings such as of automobiles.

BACKGROUND ART

Minnesota Mining and Manufacturing Company (3M), the assignee of this application, has developed a system commercially designated "Finesse-it TM System" for removing defects such as dust in paint coatings, and particularly in the new hi-solids enamel coatings used on automobiles, which system is more fully described in advertising brochure No. 60-4400-0344-4 (761)VP available from 3M's Industrial Abrasives Division, the content whereof is incorporated herein by reference. That system includes the use of a cylindrical back up structure with planar end surfaces disposed at angles of about ninety degrees to its axis for supporting pressure sensitive adhesive coated discs of very fine abrasive (e.g., grade 1200 or 1500) during manual manipulation of the back up structure to abrade a defect in a paint coating with the abrasive disc adhered thereto. The end surfaces on the cylindrical back up structure have diameters of about one and one quarter inch or larger which support abrasive discs of slightly larger diameters. Use of the back up structures with such abrasive discs has had a tendency to level surface roughness such as orange peel on portions of the paint surface around the defect being removed, while leveling is undesirably visually detectable if the rest of the paint on the automobile has such surface roughness as is often the case on lower cost automobiles. Also the back up structure is not as convenient to manipulate and store as might be desired.

DISCLOSURE OF INVENTION

The present invention provides a pencil like abrasive disc back up assembly for supporting coated abrasive discs which is adapted to be manually manipulated to remove surface defects such as in painted surfaces of automobiles with an abrasive disc releasably attached on the back up assembly, the use of which backup assembly has significantly less tendency to level surface roughness such as orange peel on portions of the paint surface around the defect being removed, and which back up assembly is easier to manipulate when used and to store when not in use than the back up structure described above.

The pencil like abrasive disc back up assembly according to the present invention comprises (1) an elongate rigid body member having a first socket opening through a first end; and (2) a firm resiliently flexible first support member having an inner portion in the socket, an outer portion projecting at least about one sixteenth inch and preferably about three sixteenth to three eights inch from the socket, and a planar end surface on the outer portion adapted to support one of the pressure sensitive adhesive coated abrasive discs.

Preferably the planar end surface is generally oval or circular and has a minimum transverse dimension of about one half inch and a maximum transverse dimension of about five eights inch which provides an area for the end surface that can support an abrasive disc to abrade surface defects in a paint surface without significantly leveling surface roughness such as orange peel on the paint surface around the defect. Such planar end surfaces with minimum transverse dimensions of less than about three eights inch are too small so that too much pressure is applied during abrading and damage to the paint surface can result; whereas such planar end surfaces with maximum transverse dimensions of more than about one inch have been found to be too large so that there is too much tendency to level surface roughness in the paint surface around the defect being removed.

The firm resiliently flexible support member may be of a natural rubber, a synthetic rubber such as buna-N, Hypalon or neoprene, or a polymeric material such as a methyl methacrylate, polyester or urethane, and should have surface characteristics that provide the desired level of adhesion to the pressure sensitive adhesive on the disc. Also the support member should have a durometer in the range of about 40 to 90 and preferably of about 65 which both provides a firm support surface for the abrasive disc, and allows some flexing of the support member to help align the support surface with the surface of the paint around a defect being abraded in the event of imperfect alignment of those surfaces by the user. Such flexing of the support member to help align the support surface with the surface of the paint around a defect being abraded is facilitated by having an outer portion projecting beyond the rigid body member by at least one sixteenth inch and preferably about three sixteenth to three eighth inch (although longer projecting portions could also be used) and having an inner portion preferably at least one quarter inch long in the socket so that such flexing of the support member can occur both within and without the socket.

The end surface of the first support member can be disposed at various angles with respect to the axis of the body member, including sixty degrees which places the end surface and an abrasive disc thereon at a convenient angle for use by a person grasping the body member in the manner of a pencil or other writing instrument, or at a right angle with respect to the axis of the body member which can also be useful for some purposes, or at various angles therebetween. Thus the first support member can have its support surface disposed at one such angle such as sixty degrees, the body member may have a second socket opening through a second end opposite its first end, and the back up assembly may further include a second support member having an inner portion in the second socket, an outer portion projecting at least about one sixteenth inch from the second socket, and a planar end surface on the outer portion also adapted to support one of the pressure sensitive adhesive coated abrasive discs and disposed at a different angle than the support surface of the first support member, such as an angle of about ninety degrees with respect to the axis of the body member, so that the user has a selection of support surface orientations on which to support an abrasive disc which is typically larger in diameter than the support surface.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
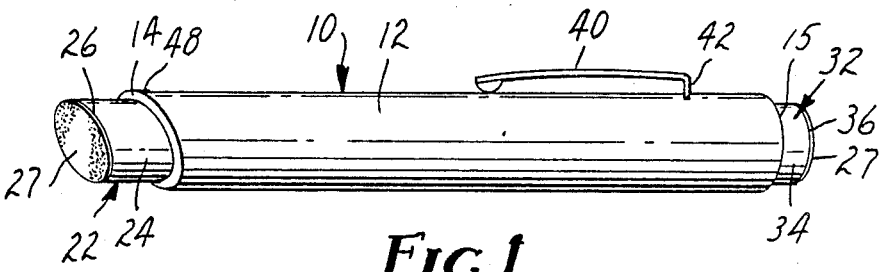
FIG. 1 is a perspective view of a pencil like back up assembly according to the present invention.
Figure 2:
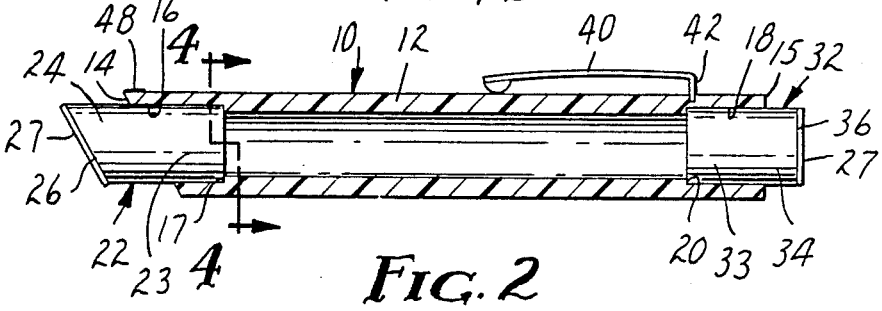
FIG. 2 is a longitudinal sectional view of the back up assembly of FIG. 1.
Figure 3:
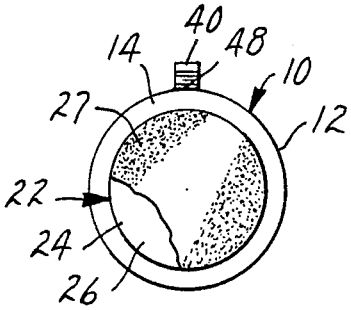
FIG. 3 is an enlarged end view of the back up assembly of FIG. 1.
Figure 4:
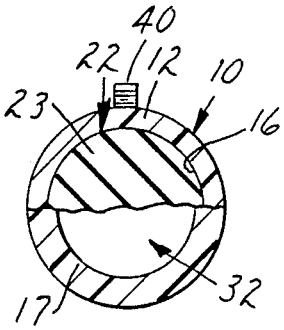
FIG. 4 is an enlarged sectional view taken approximately along line 4—4 of FIG. 2.

Referring now to the drawing, there is shown a manually manipulatable pencil like back up assembly 10 according to the present invention for supporting pressure sensitive adhesive coated abrasive discs 27 adhered to the back up assembly 10 while abrading defects in painted surfaces such as of automobiles with the abrasive discs 27.

Generally the back up assembly 10 comprises an elongate hollow cylindrical body member 12 of a rigid material (e.g., metal or polymeric material), which body member 12 has a central axis, first and second axially spaced planar ends 14 and 15 disposed at sixty and ninety degrees with respect to its axis, respectively, a first socket 16 with a cylindrical coaxial inner surface opening through its first end 14, which first socket 16 has an inner end defined by an annular ledge 17 recessed from the first end 14, and a second socket 18 with a cylindrical coaxial inner surface opening through its second end 15, which second socket has an inner end defined by an annular ledge 20 recessed from the second end 15.

Also included in the back up assembly 10 is a first cylindrical support member 22 of a firm resiliently flexible material having an inner portion 23 extending into the first socket 16 where it may be frictionally received, adhered or mechanically fastened, an outer portion 24 projecting from the first socket 16, and a planar end surface 26 with a generally oval periphery on the outer portion 24 disposed at an angle of about sixty degrees with respect to the axis of the body member 12 and parallel to its end 14, which end surface 26 is adapted to support a pressure sensitive adhesive coated abrasive disc 27 releasably adhered to the end surface 26 by a layer of pressure sensitive adhesive on the disc 27; and a second cylindrical support member 32 of a firm resiliently flexible material having an inner portion 33 extending into the second socket 18 where it may be frictionally received, adhered or mechanically fastened, an outer portion 34 projecting from the second socket 18, and a planar end surface 36 with a circular periphery on the outer portion 34 disposed at an angle of about ninety degrees with respect to the axis of the body member 12 and parallel to its end 15, which end surface 36 is also adapted to support a pressure sensitive adhesive coated abrasive disc 27 releasably adhered to the end surface 36 by a layer of pressure sensitive adhesive on the disc 27. The support member 32 should have a beveled edge around the periphery of its end surface 36 to restrict damage by that edge during use of the back up assembly 10 to abrade surfaces with abrasive discs 27 (which discs 27 are typically of larger diameter than the end surfaces 26 and 36) adhered over the end surface 36.

As illustrated, the back up assembly 10 may further include an elongate resiliently flexible clip 40 having a first end 42 attached along the outer surface of the body member 12 adjacent the second support member 32 and extending axially along the body member toward the first support member 22, which clip 40 is adapted to engage over the upper portion of a shirt or jacket pocket in which the back up assembly is stored.

Preferably, the body member 12 has a mark 48 made with ink or by drilling or cutting the body member 12 adjacent the outermost point of the end 14 to indicate to a user the location of the outermost edge of the end surface 26 with respect to the center of the body member 12, and thereby help the user align the end surface 26 with a surface to be abraded by an abrasive disc 27 on the end surface 26.

As a preferred non limiting example of the materials and dimensions of the back up assembly 10, the body member 12 may be an about four inch long length of polyvinyl chloride pipe having an outside diameter of about five eights inch, and the sockets may each be a minimum of about one half inch deep. The support members 22 and 32 may be lengths of one half inch diameter neoprene rubber cording having a durometer of about 65, and may project from the sockets 16 and 18 by about three eights inch.

The present invention has now been described with reference to a single embodiment thereof. It will be apparent to those skilled in the art that many changes can be made in the embodiment described without departing from the scope of the present invention. For example, the end surfaces 26 and 36 may have permanently attached thereto one portion of a hook and loop fastener, the other portion of which fastener is attached to abrasive disks so that the hook and loop fastener rather than pressure sensitive adhesive provides means for releasably attaching abrasive disks to the support surfaces 26 and 36. Thus the scope of the present invention should not be limited to the structure descried in this application, but only by structures described by the language of the claims and the equivalents of those structures.

We claim:

1. A manually manipulatable pencil like abrasive disc back up assembly for supporting coated abrasive discs while abrading away defects in an orange peal surface on paint, said assembly comprising:

an elongate rigid body member having an axis, first and second ends, and a first socket opening though said first end; and a first support member of a firm flexible material having a durometer in the range of about 40 to 90, said first support member having an inner portion in said socket, an outer portion projecting at least about one sixteenth inch from said socket, a planar end surface on said outer portion adapted to support one of the coated abrasive discs, said planar end surface having a minimum transverse dimension of greater than about three eights inch and a maximum transverse dimension of less than about one inch.

2. A back up assembly according to claim 1 wherein said end surface is disposed at an angle of about sixty degrees with respect to the axis of said body member, and said body member has a mark adjacent the portion of the edge of the end surface that is outermost with respect to the body member.

3. A back up assembly according to claim 2 wherein said body member has a second socket opening through said second end, and a second support member having an inner portion in said socket, an outer portion projecting at least about one sixteenth inch from said second socket, and a planar end surface on said outer portion disposed at an angle of about ninety degrees with respect to the axis of said body member and adapted to support one of the coated abrasive discs, said planar end surface on said second support member having a minimum transverse dimension of greater than about three eights inch and a maximum transverse dimension of less than about one inch, and said second support member being of a firm flexible material of a durometer in the range of about 40 to 90.

4. A back up assembly according to claim 1 wherein said end surface is disposed at an angle of about sixty degrees with respect to the axis of said body member, and has a minimum transverse dimension of about one half inch.

5. A back up assembly according to claim 1 wherein the outer portion of said first support member projects from said socket by about three eighth inch and said first support member has a durometer of about 65.

6. A back up assembly according to claim 1 wherein the inner portion of said first support member extends into said socket by at least about one quarter inch.

7. A manually manipulatable pencil like abrasive disc back up assembly for supporting pressure sensitive adhesive coated abrasive discs while abrading surface defects in paint, said assembly comprising:

an elongate rigid body member having an axis, first and second ends, a first socket opening through said first end, and a second socket opening through said second end;

a first cylindrical support member having a diameter of about one half inch, an inner portion extending at least about one quarter inch into said first socket, an outer portion projecting about three eighth inch from said first socket, a planar end surface on said outer portion disposed at an angle of about sixty degrees with respect to the axis of said body and adapted to support one of the pressure sensitive adhesive coated abrasive discs, said first support member being of a firm flexible material of a durometer in the range of about 40 to 90; and a second cylindrical support member having a diameter of about one half inch, an inner portion extending at least about one quarter inch into said second socket, an outer portion projecting at least about three sixteenth inch from said second socket, a planar end surface on said outer portion disposed at an angle of about ninety degrees with respect to the axis of said body and adapted to support one of the pressure sensitive adhesive coated abrasive discs, said second support member being of a firm flexible material of a durometer in the range of about 40 to 90.

8. A back up assembly according to claim 7 further including an elongate resiliently flexible pocket clip having a first end attached along the outer surface of said body member adjacent said second support member and extending axially along said body member toward said first support member.

* * * * *